US008950959B2

(12) United States Patent
Takahashi et al.

(10) Patent No.: US 8,950,959 B2
(45) Date of Patent: Feb. 10, 2015

(54) CUTTING DEVICE AND RECORDING APPARATUS

(71) Applicant: Fujitsu Component Limited, Tokyo (JP)

(72) Inventors: Kohei Takahashi, Tokyo (JP); Masahiro Kaneko, Tokyo (JP); Nobuo Yatsu, Tokyo (JP); Takuya Uchiyama, Tokyo (JP); Natsumi Sakai, Tokyo (JP); Katsuaki Koshimura, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 61 days.

(21) Appl. No.: 13/688,503

(22) Filed: Nov. 29, 2012

(65) Prior Publication Data

US 2013/0183076 A1 Jul. 18, 2013

(30) Foreign Application Priority Data

Jan. 13, 2012 (JP) ..... 2012-005635

(51) Int. Cl.

| | |
|---|---|
| ***B41J 11/70*** | (2006.01) |
| ***B26D 1/06*** | (2006.01) |
| ***B26D 1/10*** | (2006.01) |
| ***B26D 1/18*** | (2006.01) |
| ***B26D 5/16*** | (2006.01) |
| ***B26D 5/08*** | (2006.01) |
| ***B26D 1/04*** | (2006.01) |
| ***B26D 1/20*** | (2006.01) |
| *B26D 7/00* | (2006.01) |

(52) U.S. Cl.

CPC ..... *B41J 11/706* (2013.01); *B26D 5/16* (2013.01); *B26D 1/185* (2013.01); *B26D 1/065* (2013.01); *B26D 2007/005* (2013.01); *B26D 5/083* (2013.01); *B26D 1/045* (2013.01); *B26D 1/20* (2013.01)

USPC ..... 400/621; 83/56; 83/614; 83/638; 83/647

(58) Field of Classification Search

CPC ..... B41J 11/706; B26D 1/185; B26D 1/065; B26D 1/105

USPC ..... 400/621; 399/385; 101/117, 224, 226; 83/487, 646, 694, 614, 636, 638, 56, 83/578, 627, 647

See application file for complete search history.

(56) References Cited

U.S. PATENT DOCUMENTS 326,916 A * 9/1885 Morse, Jr. ..... 83/458
5,003,856 A * 4/1991 Fujimura et al. ..... 83/576

FOREIGN PATENT DOCUMENTS

JP H0780327 * 8/1995 ..... B26D 1/04
JP 08-290387 11/1996
JP 2005-329704 12/2005

* cited by examiner

*Primary Examiner* — Blake A Tankersley
(74) *Attorney, Agent, or Firm* — IPUSA, PLLC

(57) ABSTRACT

A cutting device includes a cutting blade configured to cut a recording medium; a support unit that supports the cutting blade to be movable in an inclined direction with respect to a surface of the recording medium such that the cutting blade is moved toward the recording medium while moving in a width direction of the recording medium; and a movable unit that causes the cutting blade supported by the support unit to be moved in the inclined direction to cut the recording medium.

11 Claims, 15 Drawing Sheets

CUTTING DEVICE AND RECORDING APPARATUS

BACKGROUND OF THE INVENTION

1. Field of the Invention

The present invention relates to a cutting device and a recording apparatus including the cutting device.

2. Description of the Related Art

In a recording apparatus such as a thermal printer, a label printer or the like that records or prints characters or the like on a continuous recording medium such as a rolled paper or the like, a cutting device for cutting the recording medium to be ejected outside is necessary. For the cutting device, a guillotine cutter in which a cutting blade extending in a width direction of a recording medium moves in a vertical direction with respect to a surface of the recording medium to cut the recording medium, a slide cutter in which a cutting blade slides from one end to the other end of a recording medium in a width direction to cut the recording medium, and the like are known as cutting mechanisms (Patent Document 1 or Patent Document 2, for example).

However, in the cutting device such as the guillotine cutter, the slide cutter, or the like, the recording medium may not be surely cut based on a state of the transferred recording medium such as looseness, folds or the like, or a state of the cutting blade caused by damage or the like. Further, when the cutting function of the cutting device is not good, even if the recording medium is cut, a deviation, folds or the like is generated on the recording medium by the operation of the cutting blade. In such a case, a cut portion in the subsequent recording medium may cause the cutting blade or the like to generate a paper jam.

[Patent Document]

[Patent Document 1] Japanese Laid-open Patent Publication No. 2005-329704

[Patent Document 2] Japanese Laid-open Patent Publication No. H08-290387

SUMMARY OF THE INVENTION

According to an embodiment, there is provided a cutting device including a cutting blade configured to cut a recording medium; a support unit that supports the cutting blade to be movable in an inclined direction with respect to a surface of the recording medium such that the cutting blade is moved toward to the recording medium while moving in a width direction of the recording medium; and a movable unit that causes the cutting blade supported by the support unit to be moved in the inclined direction to cut the recording medium.

According to another embodiment, there is provided a recording apparatus including a recording unit that records an image on the recording medium; and the above cutting device.

BRIEF DESCRIPTION OF THE DRAWINGS

Other objects, features and advantages of the present invention will become more apparent from the following detailed description when read in conjunction with the accompanying drawings.

FIG. 2A and FIG. 25 are perspective views showing an example the thermal printer of the first embodiment when a paper is being transferred;

FIG. 9A and FIG. 93 are views showing an example of a structure of the carrier and the cutting blade of the first embodiment;

FIG. 14A and FIG. 143 are perspective views showing an example of a structure and an operation of the cutting device of the third embodiment.

DETAILED DESCRIPTION OF THE PREFERRED EMBODIMENTS

Figure 1A:
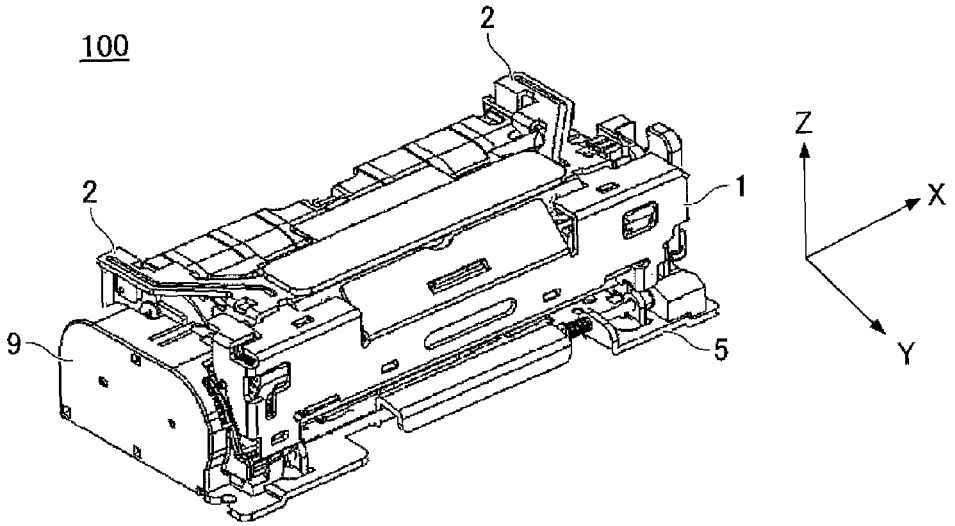
FIG. 1A and FIG. 1B are perspective views showing an example of a thermal printer of a first embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

First Embodiment (Structure of Thermal Printer)

Figure 13A:
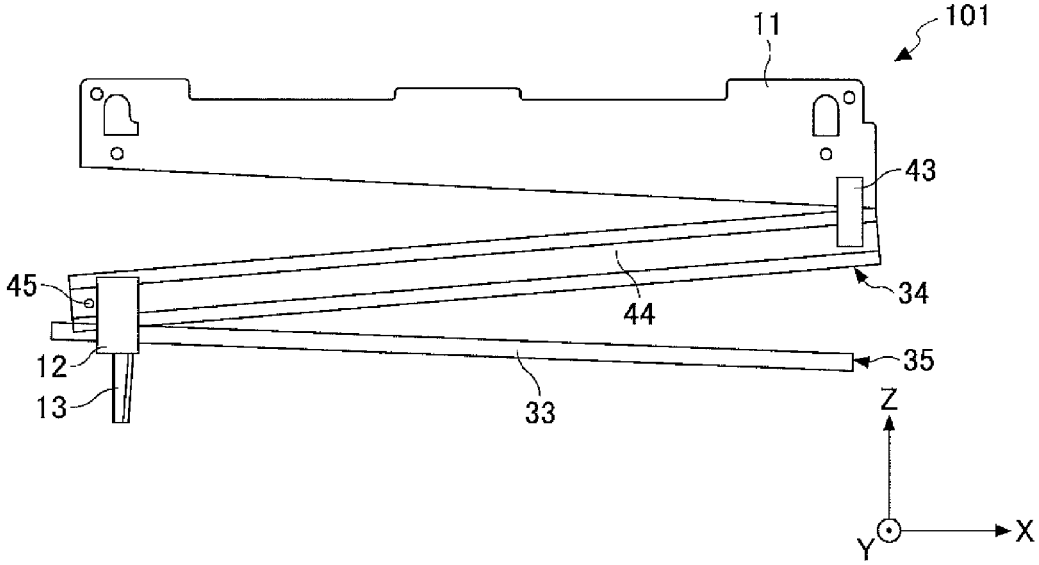
FIG. 13A and FIG. 13B are views showing an example of a structure and an operation of a cutting device of a third embodiment.
Figure 13B:
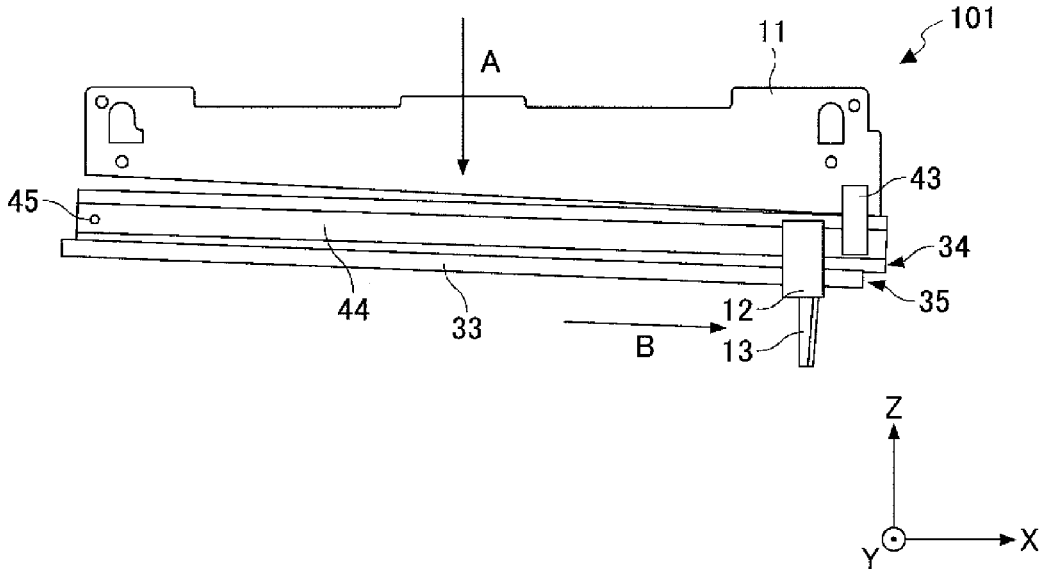
Figure 14A:
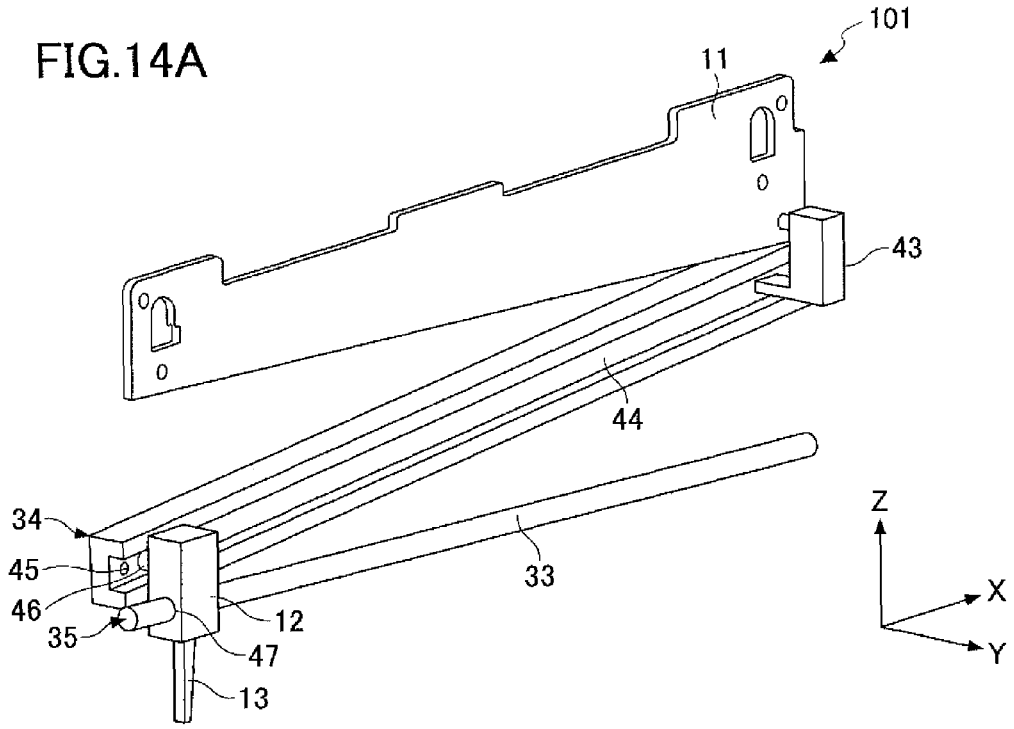
Figure 14B:
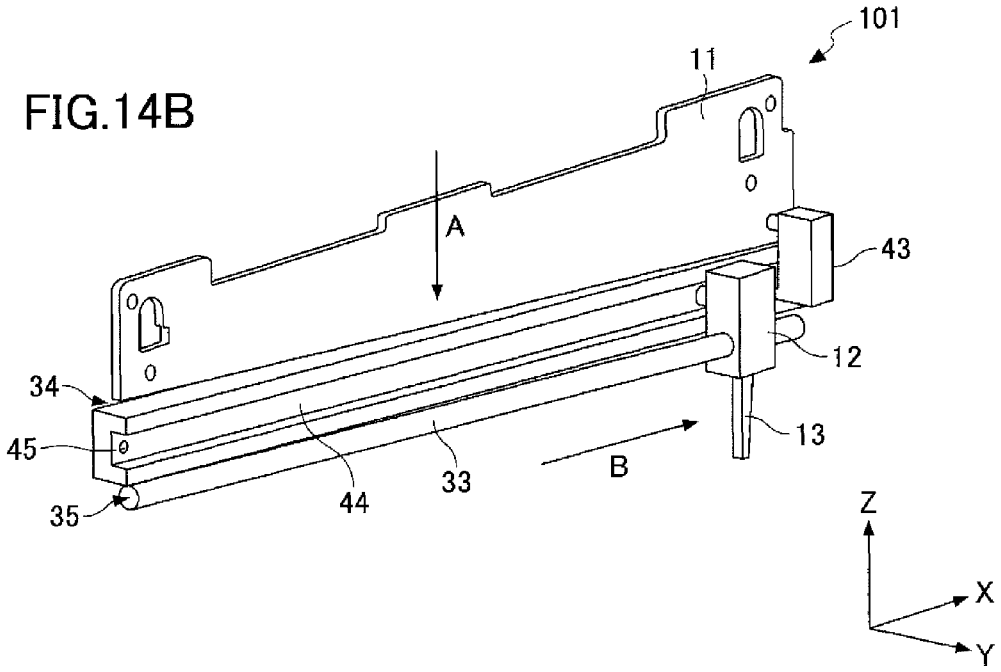

FIG. 1A and FIG. 13 are perspective views showing an example of a thermal printer 100 of the first embodiment. Here, in the drawings, a width direction of the thermal printer 100 is referred to as an X-direction, a transferring direction of a paper, which is perpendicular to the X-direction, is referred to as a Y-direction, and a height direction of the thermal printer 100 is referred to as a Z-direction.

The thermal printer 100 is an example of a recording apparatus that transfers a paper, which is a recording medium, prints a character and an image on a surface of the paper, cuts the paper, and ejects the cut paper.

Figure 1B:
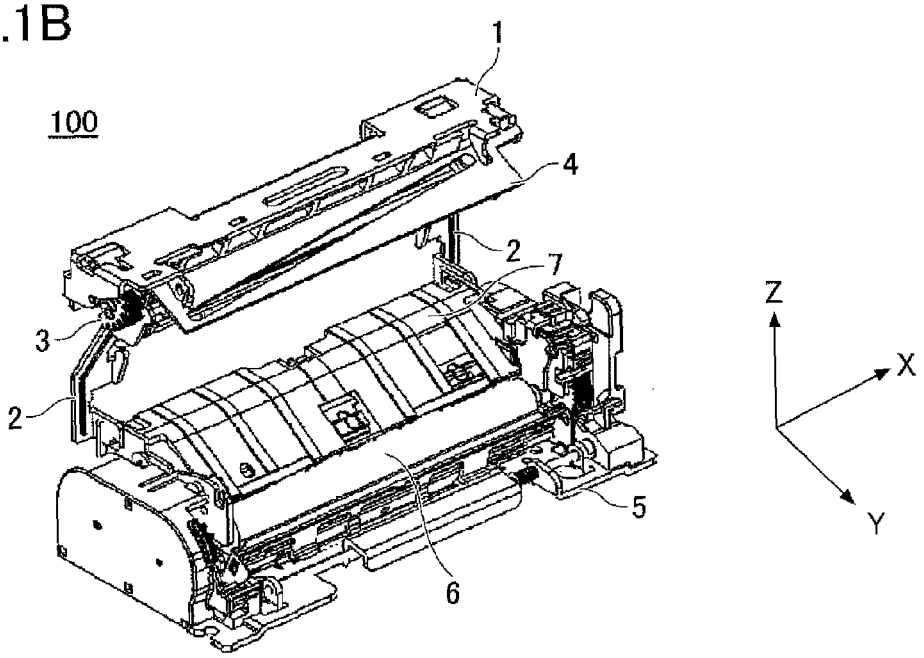

The thermal printer 100 includes a movable unit 1, movable unit support members 2, a gear 3 and a fixed unit 5. The movable unit 1 is capable of rotating with respect to the fixed unit 5 to be open and closed. FIG. 1A shows a state where the movable unit 1 is closed and FIG. 1B shows a state where the movable unit 1 is open.

The movable unit support members 2 are rotatably supported by the fixed unit 5 at an end portion thereof. The movable unit 1 is supported by the movable unit support members 2 to be capable of being rotated with respect to the fixed unit 5 while having the end portions of the movable unit support members 2 as a center of the rotation.

The movable unit 1 includes a thermal head, not shown in the drawings, a cutting blade and a support member 4 of a cutting device, which will be explained later, and the like. The thermal head is used for printing a character or the like on the surface of the paper. The cutting blade is used for cutting the transferred paper on which the character or the like is printed. The support member 4 supports the cutting blade.

The fixed unit 5 includes a platen roller 6, a fixed blade of the cutting device, which will be explained later, and the like. The platen roller 6 is used for transferring the paper while pushing the paper toward the thermal head of the movable unit 1. The paper is transferred through a paper transfer path 7. The fixed blade is used for cutting the transferred paper on which the character or the like is printed in conjunction with the cutting blade of the movable unit 1.

Figure 2A:
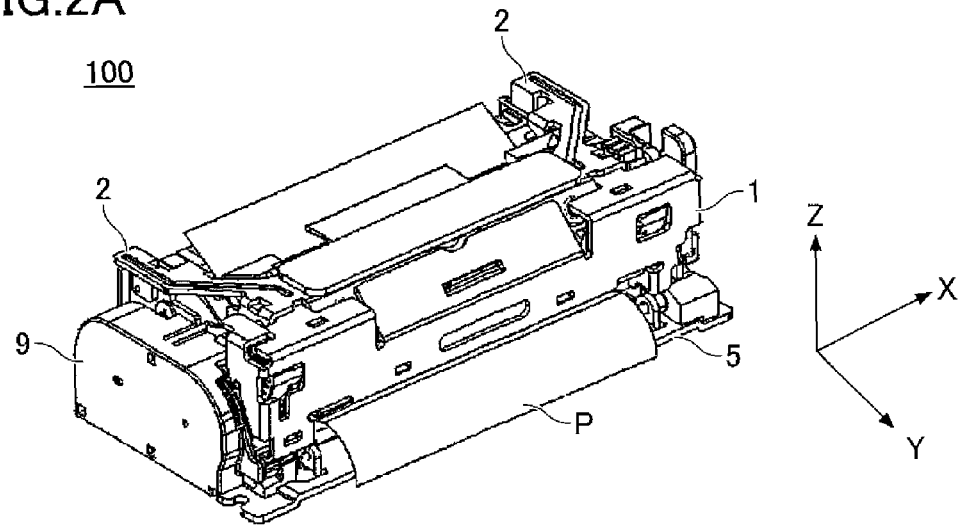
Figure 2B:
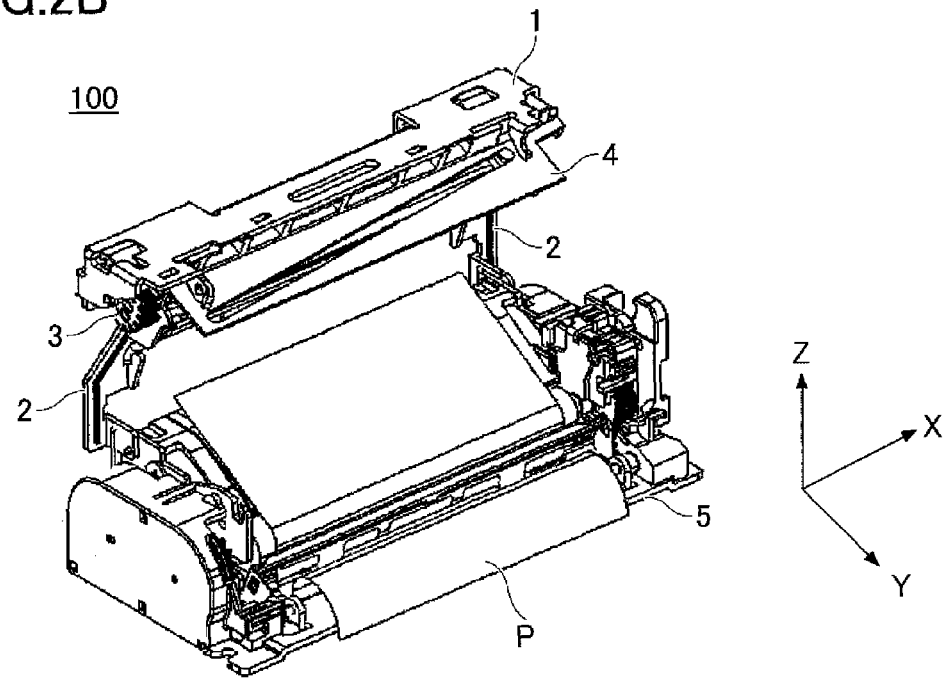

FIG. 2A and FIG. 2B are perspective views showing an example the thermal printer 100 of the first embodiment when the paper is being transferred. FIG. 2A shows a state where the movable unit 1 is closed and FIG. 2B shows a state where the movable unit 1 is open.

As shown in FIG. 2A and FIG. 2B, a paper P is transferred between the movable unit 1 and the fixed unit 5. Then, the character or the like is printed on a surface of the paper P at a position between the thermal head of the movable unit 1 and the platen roller 6 (see FIG. 1B) of the fixed unit 5. The paper P is further transferred by the platen roller 6 that is driven to be rotated. The transferred paper P is cut by the cutting blade of the movable unit 1 and the fixed blade of the fixed unit 5 at a predetermined position to be ejected.

(Structure of Cutting Device)

Figure 3:
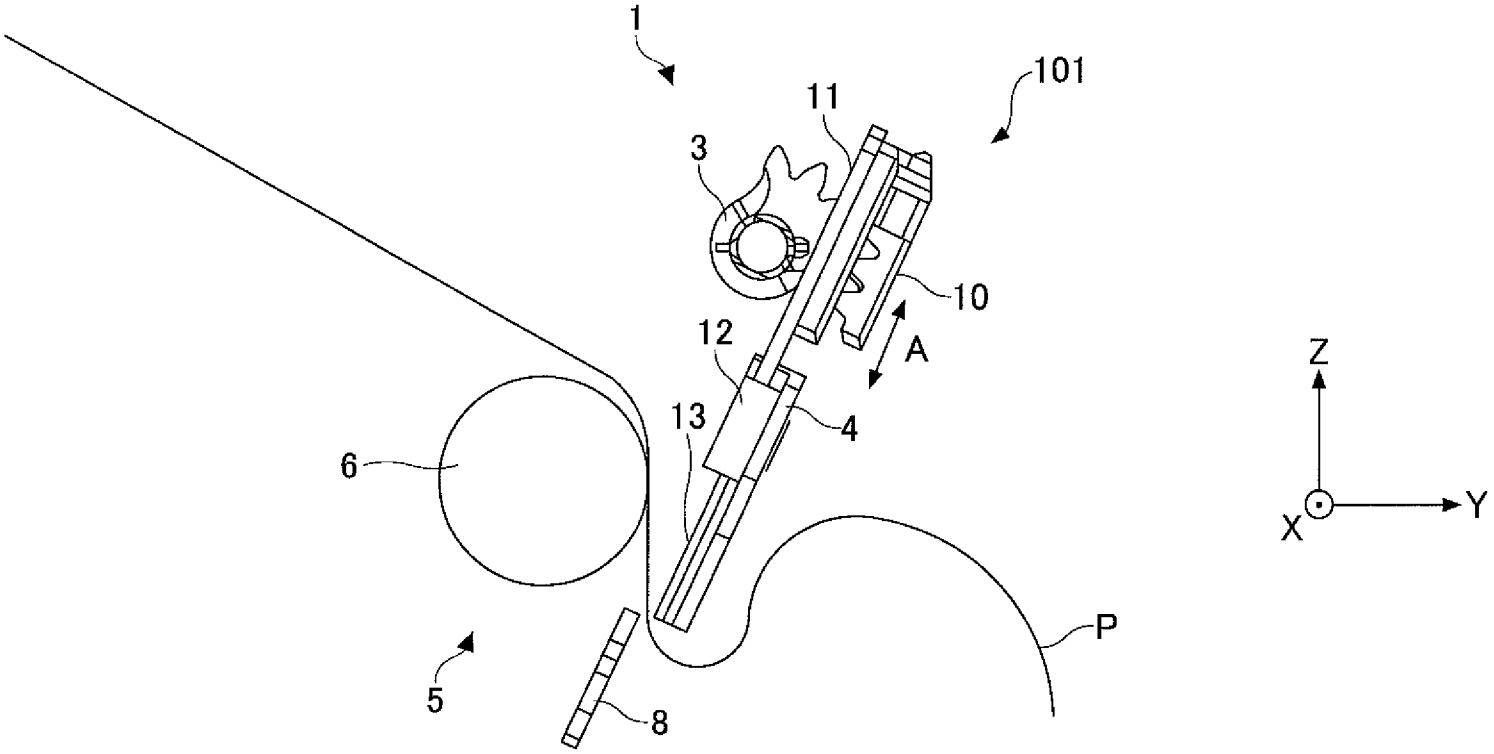
FIG. 3 is a schematic view showing an example of a structure of a cutting device of the first embodiment.
Figure 4:
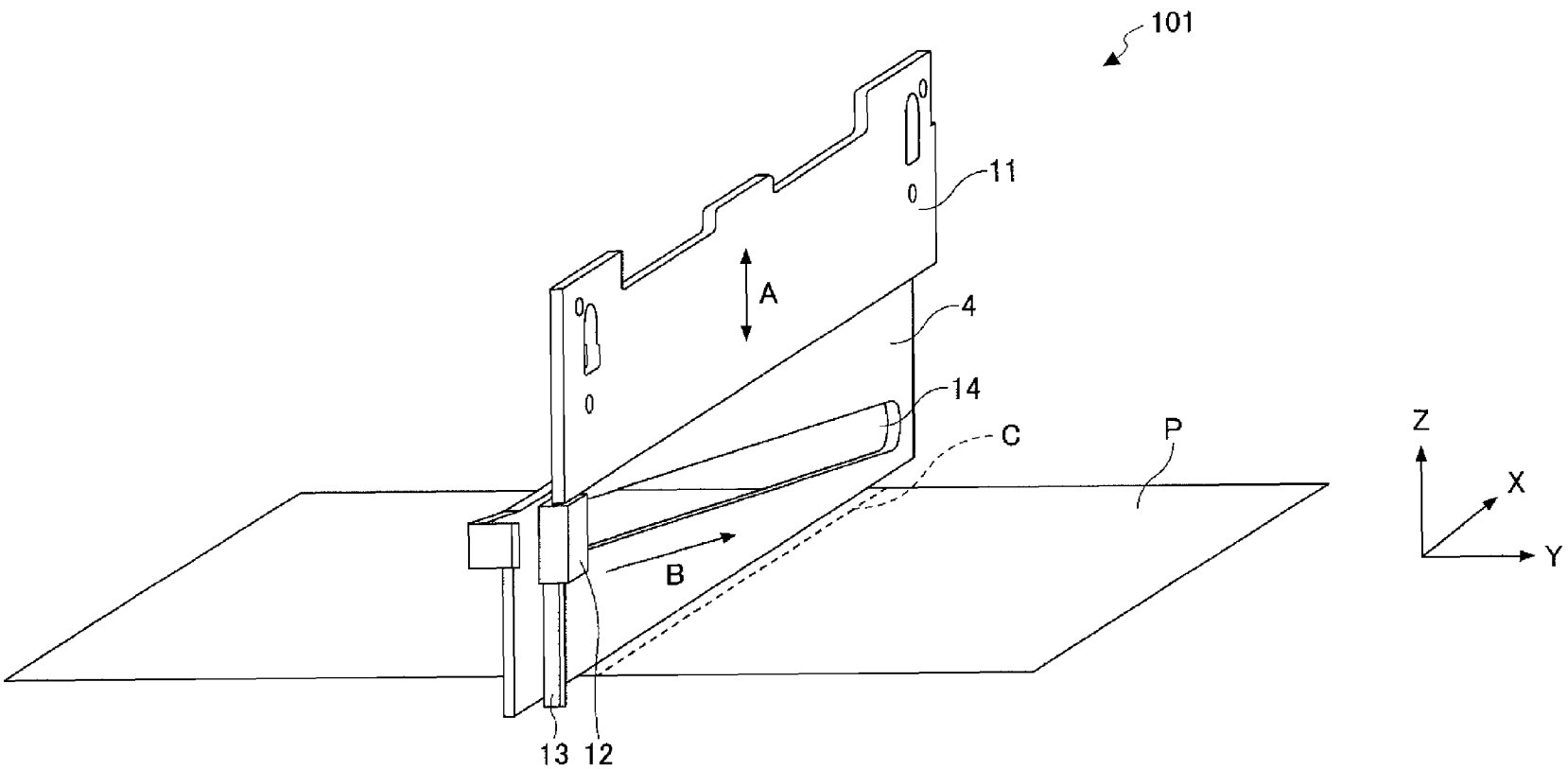
FIG. 4 is a perspective view showing an example of a structure of the cutting device of the first embodiment.

FIG. 3 is a side view showing an example of a cutting device 101 of the first embodiment. FIG. 4 is a perspective view showing an example of the cutting device 101 of the first embodiment.

As shown in FIG. 3, the cutting device 101 includes a movable member 11 (movable unit), the support member 4 (support unit), a carrier 12 (support unit) and a cutting blade 13 provided in the movable unit 1, and a fixed blade 8 provided in the fixed unit 5. The cutting device 101 cuts the paper P on the surface of which the character or the like is printed at a position downstream of the platen roller 6.

The cutting blade 13 is detachably supported by the carrier 12. As shown in FIG. 4, the carrier 12 is provided in the support member 4 to be movable in an inclined direction with respect to the surface of the paper P while supporting the cutting blade 13. Here, the "inclined direction with respect to the surface of the paper P" means a direction shown by an arrow B in FIG. 4. Further, "movable in an inclined direction with respect to the surface of the paper P" means that the carrier 12 and the cutting blade 13 are moved in an inclined direction with respect to both the width direction of the paper P (the X-direction) and the vertical direction (the Z-direction) with respect to the surface of the paper P. In this embodiment, the cutting blade 13 cuts the paper P in a direction perpendicular to the width direction of the paper P.

The movable member 11 is movable in a direction (a direction shown by an arrow A) to be closer to and farther from the surface of the paper P. The movable member 11 includes a rack gear unit 10 that engages the gear 3. The gear 3 is driven to be rotated by a motor of the thermal printer 100, not shown in the drawings. The movable member 11 is moved by the gear 3 and the rack gear unit 10 in the direction shown by the arrow A to contact the carrier 12 to move the carrier 12 in a downward direction. Thus, the paper P is cut between the cutting blade 13, which is moved downward with the movement of the movable member 11, and the fixed blade 8. The fixed blade 8 is provided to contact the cutting blade 13 when the cutting blade 13 is moved in the inclined direction B to cut the paper P in conjunction with the cutting blade 13.

As shown in FIG. 4, the movable member 11 is a plate member having a greater length in a width direction of the paper P. The movable member 11 is provided to be movable in a direction (the direction shown by the arrow A) closer to and farther from the surface of the paper P. An end of the movable member 11 closer to the paper P contacts the carrier 12. The support member 4 is also a plate member having a greater length in the width direction of the paper P. The support member 4 is provided with an open portion 14 having a slot shape extending in an inclined direction with respect to the surface of the paper P. The support member 4 movably supports the carrier 12 that holds the cutting blade 13 along the open portion 14.

When cutting the paper P, first, the movable member 11 is moved to be close to the surface of the paper P to push the carrier 12 and the cutting blade 13 so that the carrier 12 and the cutting blade 13 move in the direction shown by the arrow B along the open portion 14 provided in the support member 4. Thus, the cutting blade 13 is moved in the direction shown by the arrow B with the carrier 12 from one end to the other end of the paper P in the X-direction while moving in the direction (the Z-direction) perpendicular to the surface of the paper P. As will be explained later with reference to FIG. 10A and FIG. 10B, the cutting blade 13 is provided with a single-edge blade which faces a moving direction (the X-direction) and extends in the Z-direction. Thus, the paper P is cut by the cutting blade 13 and the fixed blade 8, not shown in FIG. 4, along a cutting line C.

(Cutting Operation of Paper)

Figure 5A:
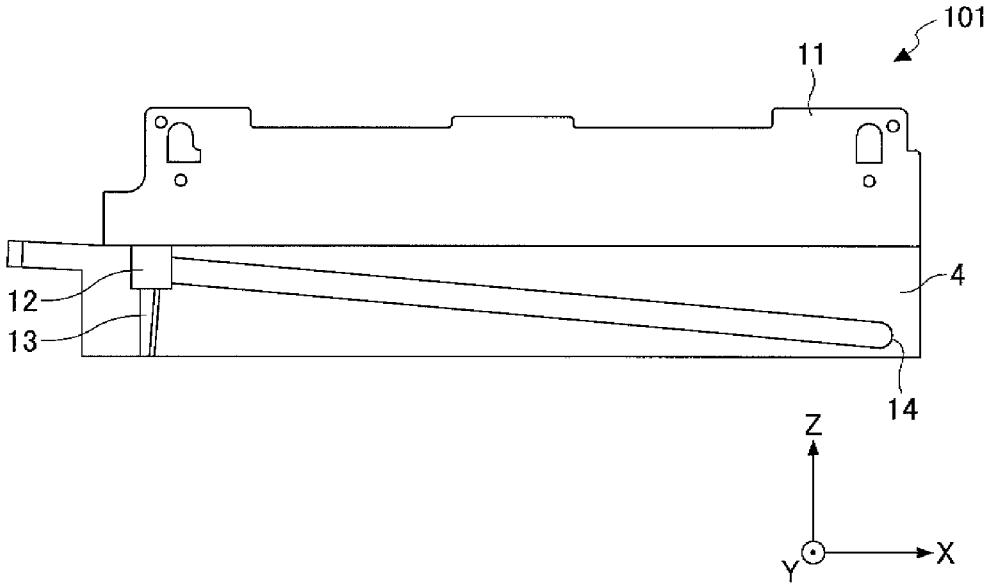
FIG. 5A and FIG. 5B are views showing an example of an operation of a cutting blade of the first embodiment.
Figure 5B:
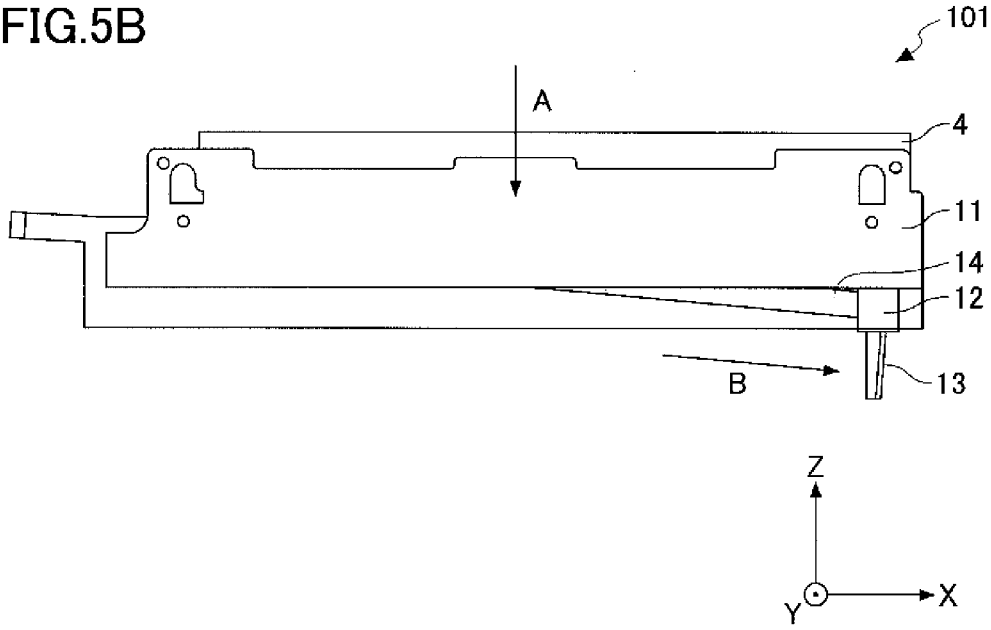

FIG. 5A and FIG. 5B are views showing an example of an operation of the cutting blade 13 of the first embodiment. FIG. 5A shows a state before cutting the paper P, and FIG. 5B shows a state after cutting the paper P.

As described above, the movable member 11 is provided to contact an upper end of the carrier 12 that supports the cutting blade 13. The carrier 12 is provided to be movable along the open portion 14 of the support member 4 in conjunction with the cutting blade 13 (FIG. 5A).

With this structure, when the movable member 11 is moved in the direction shown by the arrow A, the carrier 12 is pushed by the movable member 11 to be moved along the open portion 14 of the support member 4 with the cutting blade 13 in the direction shown by the arrow B (FIG. 5B).

After the paper P is cut, the movable member 11 is moved to be farther from the surface of the paper P to return to an initial position (the state shown in FIG. 5A). The carrier 12 that supports the cutting blade 13 is configured to be moved back to an initial position (the state shown in FIG. 5A) by a coil spring, not shown in the drawings, or the like when the movable member 11 is return to the initial position. With this structure, the carrier 12 can be ready for the next cutting operation.

The cutting blade 13 cuts the paper P while being moved in the inclined direction with respect to the surface of the paper P. It means that the cutting blade 13 is moved in a vertical direction with respect to the surface of the paper P while sliding in a horizontal direction with respect to the surface of the paper P to cut the paper P with the fixed blade 8.

When cutting the paper P, an end, which is opposite to the carrier 12 in the Z-direction, of the cutting blade 13 contacts the paper P. Then, the cutting blade 13 is moved in the direction shown by the arrow B. At this time, the contacting position between the cutting blade 13 and the paper P moves closer to the carrier 12 and the paper P is cut by the entirety of the blade edge of the cutting blade 13.

Thus, the blade edge can be effectively used from the end to a foot so that the deterioration of the cutting blade 13 by partial damage to the cutting blade 13 can be reduced compared with the slide type cutter in which a cutting blade 13 moves in a direction (the X-direction) parallel to the surface of the paper P. Therefore, the cutting function of the cutting blade 13 can be maintained and the cutting blade 13 can be repeatedly used.

Further, as the paper P is cut by applying a force in a vertical direction with respect to the surface of the paper P in addition to a force in the horizontal direction with respect to the surface of the paper P to the paper P, the paper can be cut even when looseness, folds, or the like are generated in the transferred paper P without generating new looseness, folds or the like to ends of the paper P. Thus, generation of a paper jam caused by the cutting blade 13 or the like with the ends of a subsequently transferred paper P can be prevented.

(Structure and Operation of Movable Member)

Figure 6A:
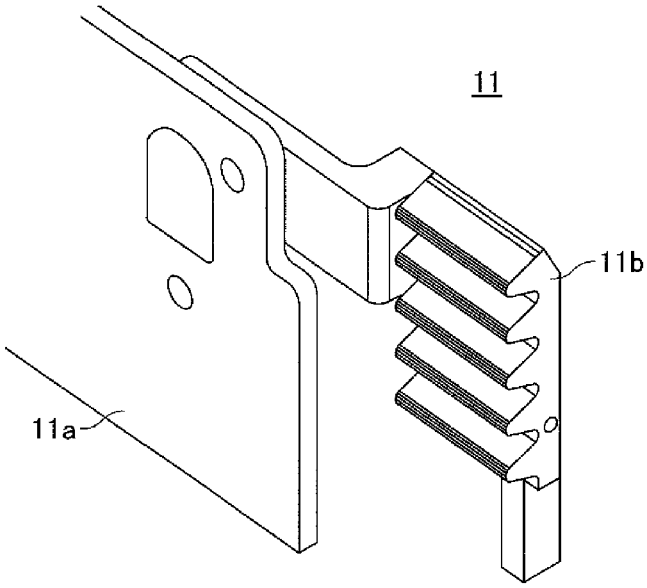
FIG. 6A to FIG. 6C are views showing an example of a structure of a movable member of the first embodiment.
Figure 6B:
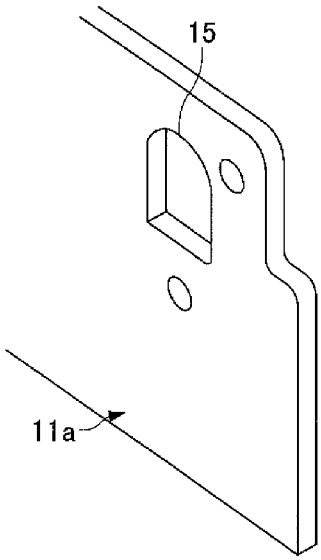
Figure 6C:
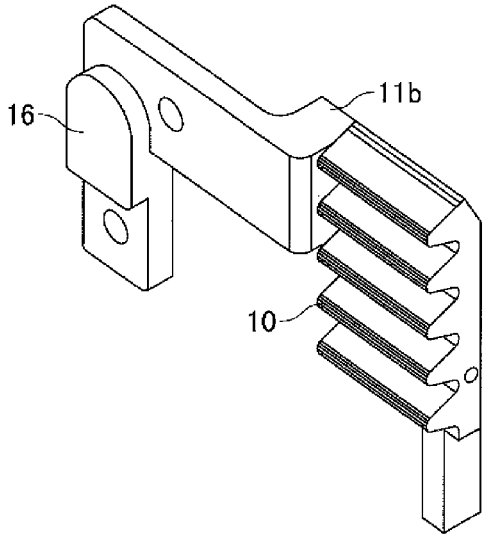

FIG. 6A to FIG. 6C are views showing an example of a structure of the movable member 11 of the first embodiment.

As shown in FIG. 6A, the movable member 11 includes a first movable member 11*a* that contacts the carrier 12 and a second movable member 11*b* that engages the gear 3.

FIG. 6B shows the structure of the first movable member 11*a*. As shown in FIG. 6A and FIG. 6B, the first movable member 11*a* is provided with a hole portion 15 that engages the second movable member 11*b*. FIG. 6C shows the structure of the second movable member 11*b*. As shown in FIG. 6A and FIG. 60, the second movable member 11*b* includes the rack gear unit 10 and a protruding portion 16 that engages the hole portion 15 of the first movable member 11*a*. By engaging the protruding portion 16 of the second movable member 11*b* with the hole portion 15 of the first movable member 11*a*, the first movable member 11*a* and the second movable member 11*b* are fixed. The gear 3 engages the rack gear unit 10 as shown in FIG. 3. Thus, with the rotation of the gear 3, the movable member 11 is moved while pushing the carrier 12.

Figure 7:
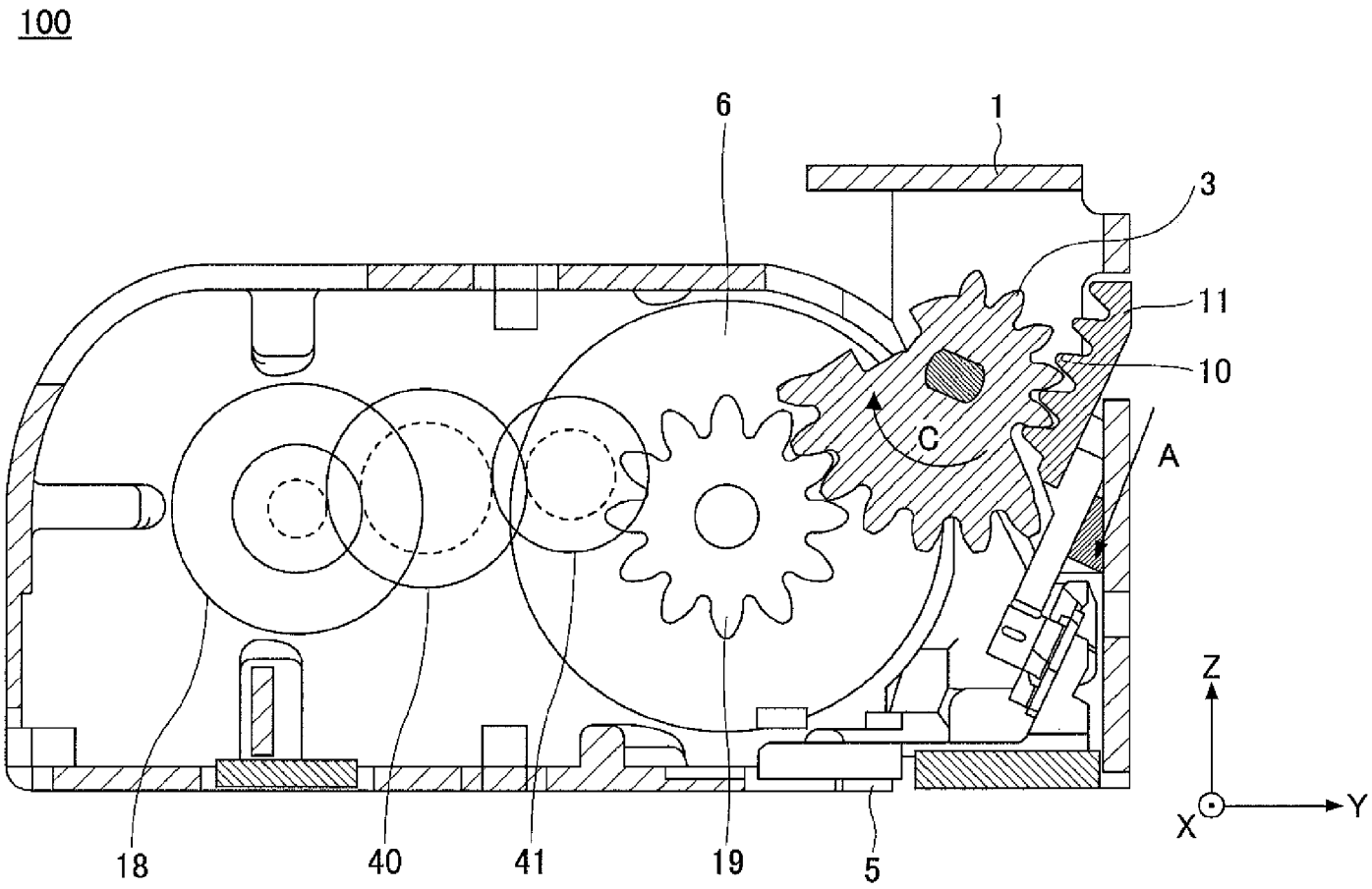
FIG. 7 is a cross-sectional view showing an example of the thermal printer of the first embodiment.

FIG. 7 is a cross-sectional view showing an example of the thermal printer 100 of the first embodiment.

The fixed unit 5 of the thermal printer 100 includes a motor 18, and transfer gears 40 and 41 inside. When the motor 18 is driven, the driving force is transmitted to a gear 19 provided at a shaft of the platen roller 6 via the transfer gears 40 and 41 to rotate the platen roller 6. Further, at this time, the gear 3 provided in the movable unit 1 is also rotated in accordance with the gear 19 in a direction shown by an arrow C. As described above, the rack gear unit 10 of the movable member 11 engages the gear 3 so that the movable member 11 is moved in a direction shown by an arrow A in accordance with the rotation of the gear 3.

(Support Member, Carrier and Cutting Blade)

Figure 8:
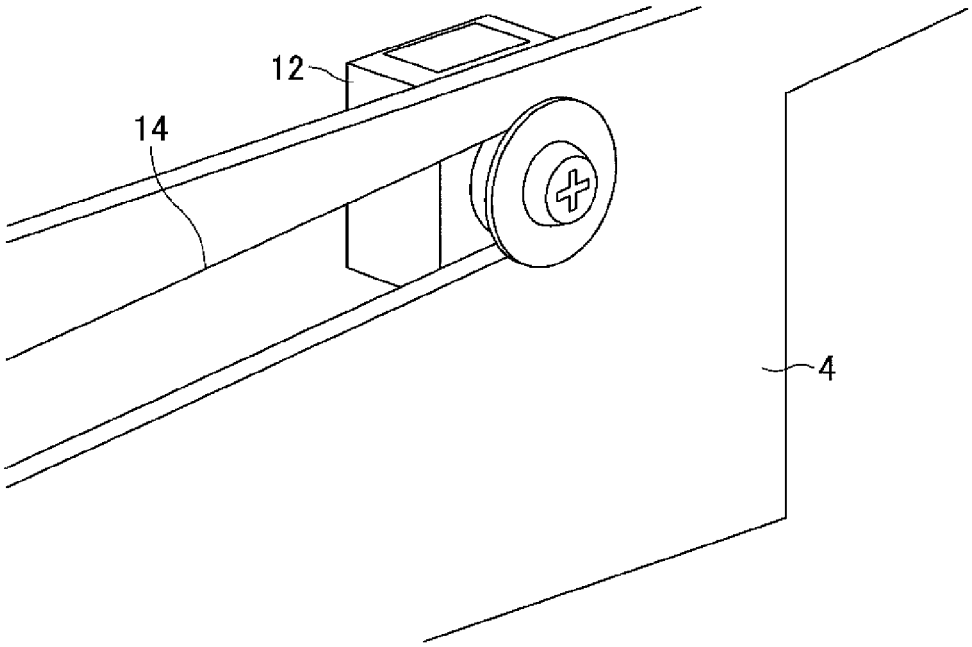
FIG. 8 is a view showing an example of a structure of a support member and a carrier of the first embodiment.
Figure 9B:
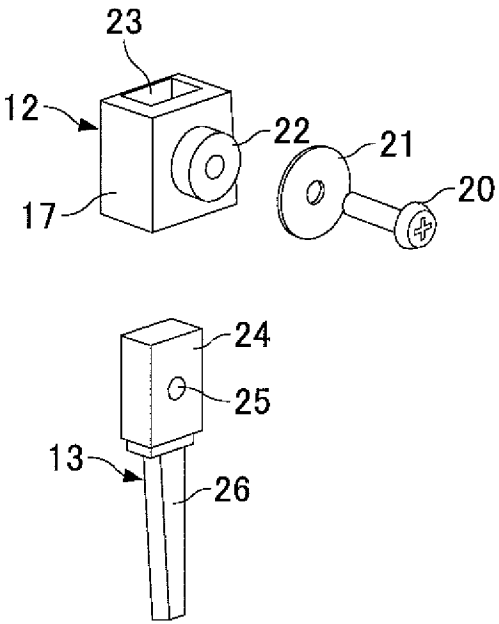
Figure 9A:
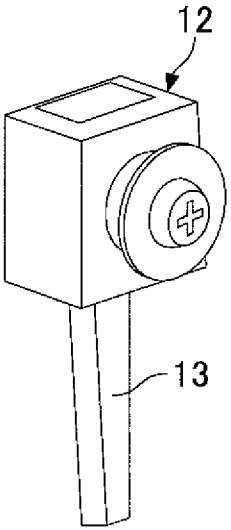

FIG. 8 is a view showing an example of a structure of the support member 4 and the carrier 12 of the first embodiment. FIG. 9A and FIG. 9B are views showing an example of a structure of the carrier 12 and the cutting blade 13 of the first embodiment.

As shown in FIG. 8 and as described above, the carrier 12 is movably supported in the open portion 14 provided in the support member 4. Further, as shown in FIG. 9A, the carrier 12 supports the cutting blade 13. As shown in FIG. 9B, the carrier 12 includes a carrier body 17 provided with an insertion hole 23 and a protruding portion 22, a screw 20 and a washer 21. The cutting blade 13 includes a blade portion 26 and an insertion portion 24 provided with a screw hole 25.

The insertion portion 24 of the cutting blade 13 is inserted in the insertion hole 23 of the carrier body 17 and fixed to the carrier body 17 by the screw 20. At this time, as shown in FIG. 8, the protruding portion 22 of the carrier 12 is inserted in the open portion 14 of the support member 4 and fixed by the screw 20 while interposing the support member 4 between the carrier body 17 and the washer 21.

When the screw 20 is detached, the cutting blade 13 can be detached from the carrier 12 and can be exchanged. Thus, when the cutting blade 13 is abraded and the cutting function becomes worse, the cutting blade 13 can be exchanged for a new one.

Contacting portions of the support member 4 and the carrier 12 may be formed by a resin having a good sliding function, such as polyacetal or the like.

Figure 10B:
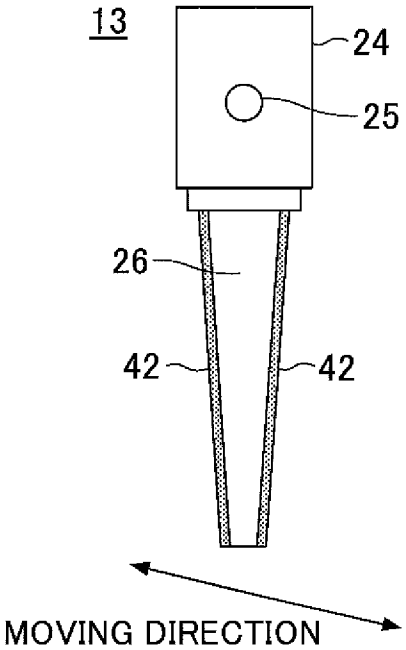
FIG. 10A and FIG. 10B are views showing an example of a structure of the cutting blade of the first embodiment.
Figure 10A:
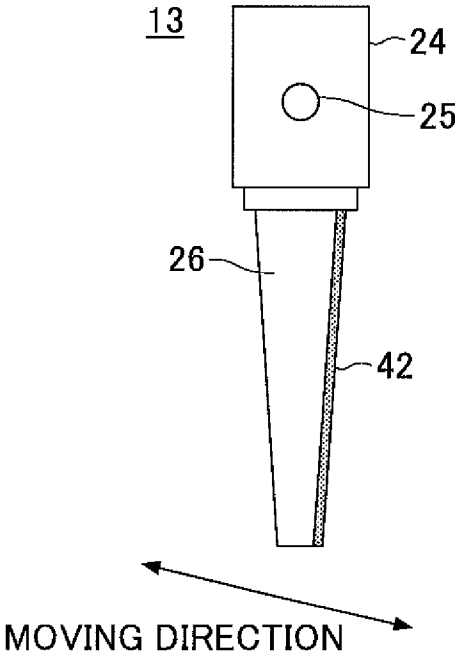

FIG. 10A and FIG. 10B are views showing examples of the cutting blade 13.

The cutting blade 13 may include a blade 42 with a single cutting edge (single-edge) which is provided at one side of a moving direction as shown in FIG. 10A. Alternatively, the cutting blade 13 may include double edge blades with cutting edges provided at both sides of moving directions as shown in FIG. 105. By having the cutting blade 13 include the double-edged blades, the cutting blade 13 is capable of cutting the paper P in both directions.

Figure 11B:
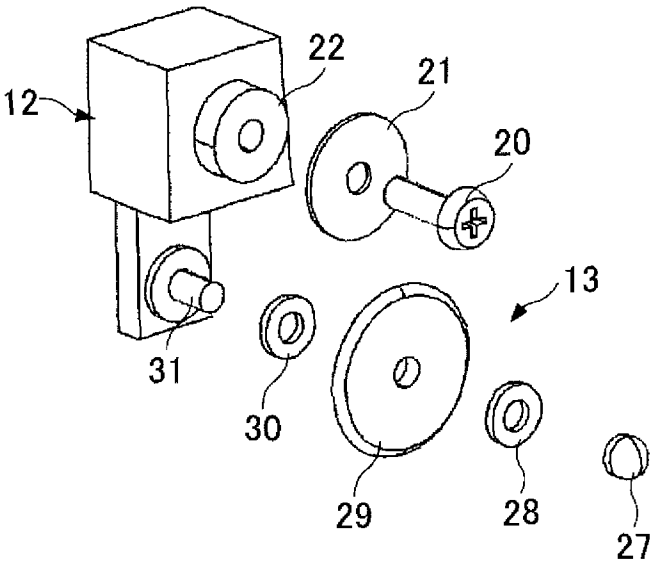
FIG. 11A and FIG. 11B are views showing an example of a structure of the cutting blade of the first embodiment.
Figure 11A:
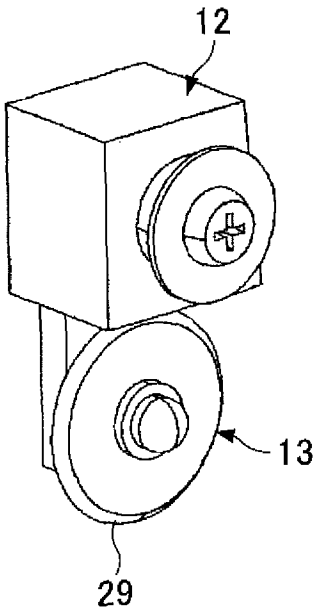

Alternatively, as shown in FIG. 11A and FIG. 11B, the cutting blade 13 may be a circular knife 29. When the circular knife 29 is used, the carrier 12 is provided with a shaft 31 which can rotatably support the circular knife 29. Then, the circular knife 29 is fixed to the shaft 31 of the carrier 12 by a cap 27 via washers 28 and 30.

The circular knife 29 is provided with a blade edge at the periphery which cuts the paper P. The circular knife 29 is configured to cut the paper P using the entirety of the blade edge while being rotated. Thus, it is possible to ensure a sufficient length of the blade edge to contact the paper P to cut the paper P. Therefore, the deterioration of the blade can be reduced and the cutting function can be maintained for long time.

Second Embodiment

Figure 12A:
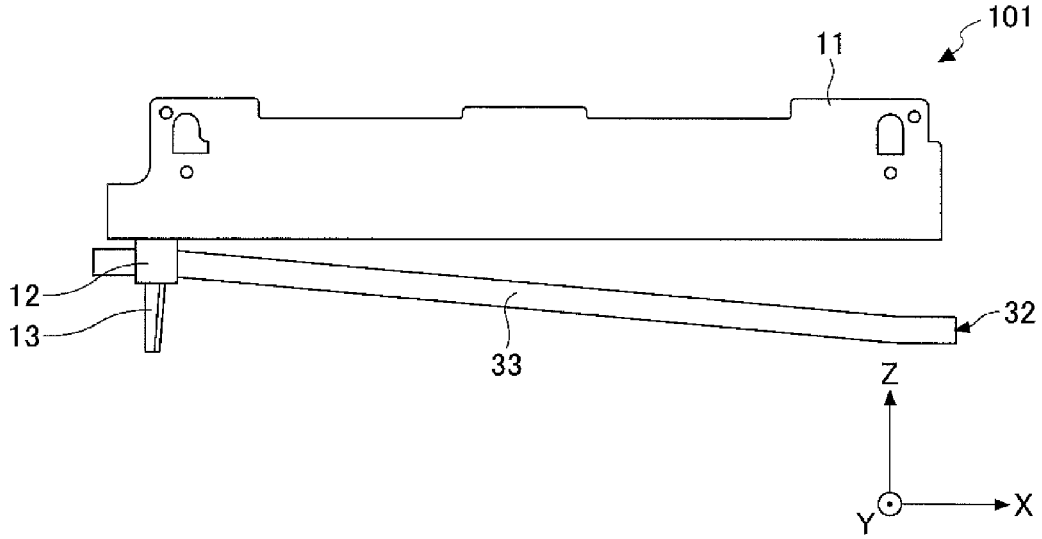
FIG. 12A and FIG. 12B are views showing an example of a structure and an operation of a cutting device of a second embodiment.
Figure 12B:
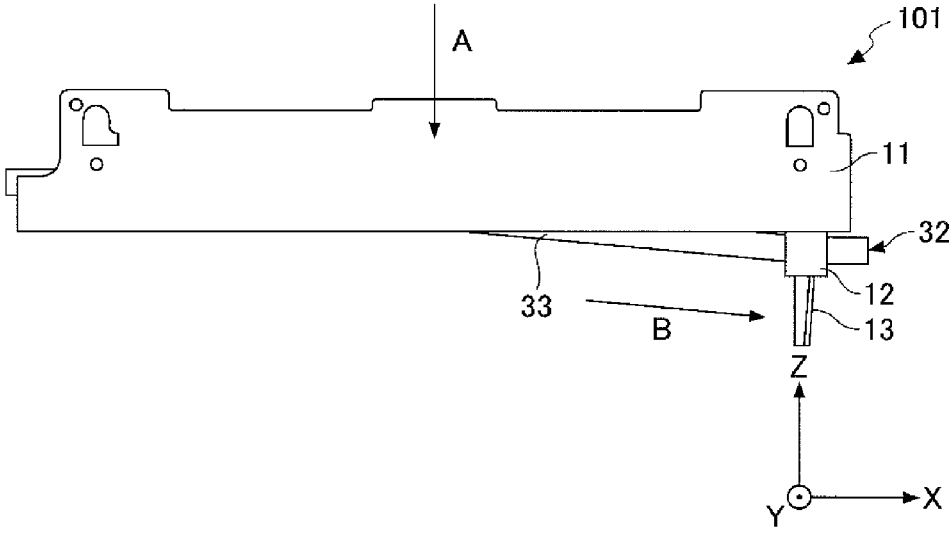

FIG. 12A and FIG. 12B are views showing an example of a structure and an operation of a cutting device 101 of the second embodiment. It is to be noted that, in the explanation of the drawings, the same components are given the same reference numerals, and explanations are not repeated.

The cutting device of the second embodiment includes a movable member 11, a support member 32, a carrier 12, and a cutting blade 13.

The movable member 11 is a plate member having a greater length in a width direction of the paper P. The movable member 11 is provided to be movable in a direction closer to and farther from the surface of the paper P. An end of the movable member 11 closer to the paper P contacts the carrier 12.

The support member 32 includes a shaft portion 33 which extends in the inclined direction with respect to the surface of the paper P. The support member 32 movably supports the carrier 12 and the cutting blade 13 along the shaft portion 33.

The carrier 12 detachably supports the cutting blade 13. As shown in FIG. 12B, when the movable member 11 is moved in the direction shown by the arrow A, the movable member 11 pushes the carrier 12 to move the carrier 12 in the direction shown by the arrow B along the shaft portion 33 of the support member 32.

The cutting blade 13 is moved in the direction shown by the arrow B with the carrier 12 from one end to the other end of the paper P in the X-direction while moving in the direction (the Z-direction) perpendicular to the surface of the paper P to be moved in the inclined direction with respect to the surface of the paper P. Thus, the paper P is surely cut by the cutting blade 13.

Third Embodiment

FIG. 13A, FIG. 13B, FIG. 14A and FIG. 14B are views for explaining a structure and an operation of a cutting device 101 of the third embodiment. It is to be noted that, in the explanation of the drawings, the same components are given the same reference numerals, and explanations are not repeated.

The cutting device 101 of the third embodiment includes a movable member 11, a first guide member 34 (support unit), a second guide member 35 (support unit), a link member 43, a rotation shaft 45 (support unit), a carrier 12 (support unit), and a cutting blade 13.

The movable member 11 is a plate member having a greater length in a width direction of the paper P. The movable member 11 supports the first guide member 34 by the link member 43 provided at an end closer to the paper P. The movable member 11 is provided to be movable in a direction closer to and farther from the surface of the paper P.

One end of the first guide member 34 is supported by the movable member 11, as described above, and the other end of the first guide member 34 is supported by the rotation shaft 45 to be rotatable around the rotation shaft 45 in accordance with the movement of the movable member 11. The first guide member 34 is provided with a groove 44 to have a "U" shape in a cross-sectional view.

The second guide member 35 includes a shaft portion 33 that extends in the inclined direction with respect to the surface of the paper P. Both ends of the second guide member 35 are fixed. The second guide member 35 movably supports the carrier 12 and the cutting blade 13 in conjunction with the first guide member 34.

The carrier 12 detachably supports the cutting blade 13. The carrier 12 is supported by the first guide member 34 and the second guide member 35 and is moved in the inclined direction with respect to the surface of the paper P along the shaft portion 33 of the second guide member 35 by the rotation of the first guide member 34 in accordance with the movement of the movable member 11.

As shown in FIG. 14R, the carrier 12 includes a protruding portion 46 that engages the groove 44 of the first guide member 34 and a hole portion 47 through which the shaft portion 33 of the second guide member 35 penetrates. The carrier 12 is movably supported by the first guide member 34 and the second guide member 35 when the protruding portion 46 engages the groove 44 of the first guide member 34 and the shaft portion 33 is inserted in the hole portion 47.

As shown in FIG. 133 and FIG. 143, when the movable member 11 is moved in the direction shown by the arrow A, the first guide member 34 is rotated around the rotation shaft 45. At this time, the carrier 12 that supports the cutting blade 13 is pushed by the first guide member 34 to be moved in the inclined direction (the direction shown by the arrow B) with respect to the surface of the paper P along the shaft portion 33 of the second guide member 35. Thus, as the cutting blade 13 supported by the carrier 12 moves in a direction (the Z-direction) perpendicular to the surface of the paper P as well as being moved in the width direction (the X-direction) of the paper P, the paper P can be surely cut.

Fourth Embodiment

Figure 15A:
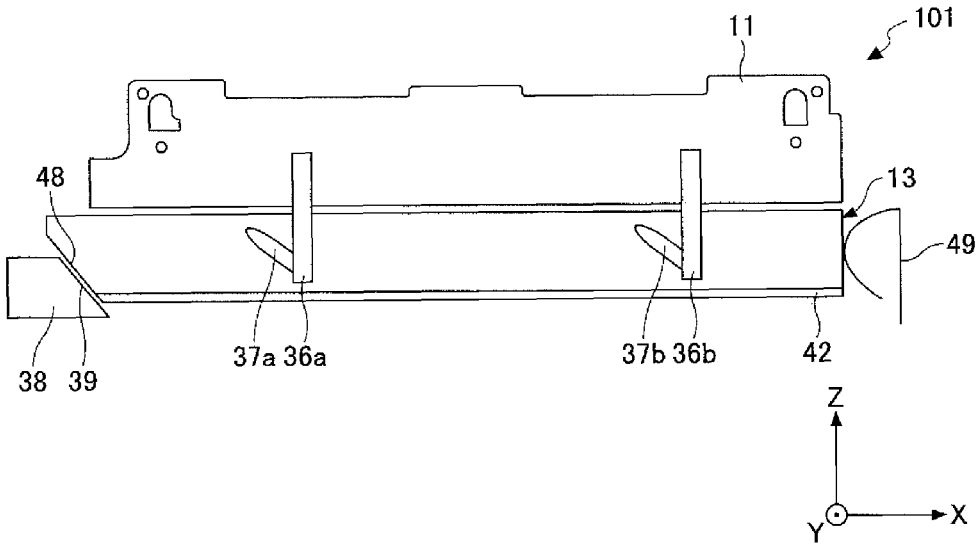
FIG. 15A and FIG. 15B are views showing an example of a structure and an operation of a cutting device of a fourth embodiment.
Figure 15B:
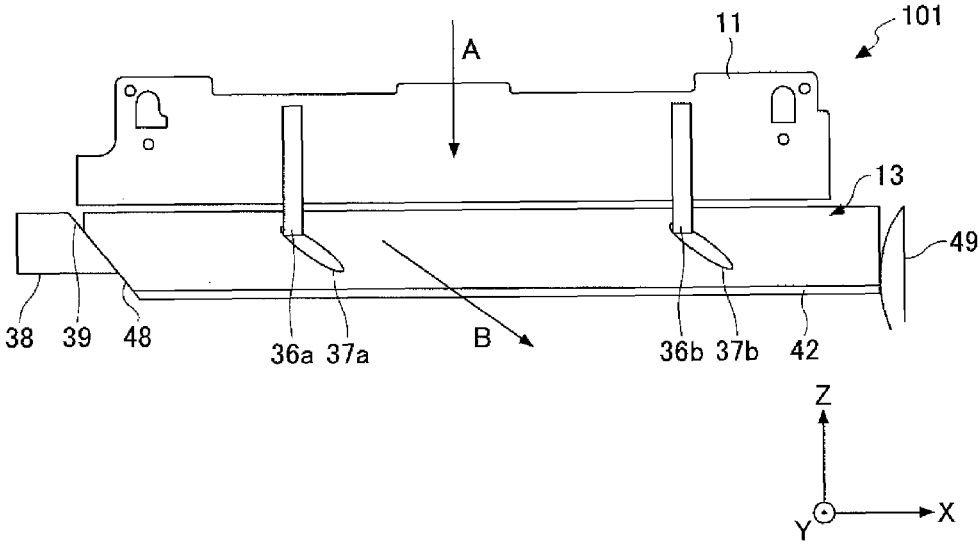

FIG. 15A and FIG. 15B are views for explaining a structure and an operation of a cutting device 101 of the fourth embodiment. It is to be noted that, in the explanation of the drawings, the same components are given the same reference numerals, and explanations are not repeated.

The cutting device 101 of the fourth embodiment includes a movable member 11, a cutting blade 13, link members 36*a* and 36*b* (support unit), a support member 38 (support unit), and a spring 49.

The movable member 11 is a plate member having a greater length in a width direction of the paper P. The movable member 11 is provided to be movable in a direction closer to and farther from the surface of the paper P. An end of the movable member 11 closer to the paper P contacts the cutting blade 13.

The support member 38 is provided with an inclined surface 39 and contacts the cutting blade 13 at the inclined surface 39 to support the cutting blade 13.

The cutting blade 13 is provided with a blade edge which extends in a direction (the X-direction) parallel to the surface of the paper P. The cutting blade 13 is movably supported by the link members 36*a* and 36*b* and the support member 38. The cutting blade 13 is provided with elongated hole portions 37*a* and 37*b* in which the link members 36*a* and 36*b* are to be inserted, respectively. The cutting blade 13 is configured such that one end portion 48 is inclined to correspond to the inclined surface 39 of the support member 38. The elongated hole portions 37*a* and 37*b* and the end portion 48 are formed to be inclined with respect to the surface of the paper P. The spring 49 is provided at an end portion of the cutting blade 13 opposite to the support member 38. The spring 49 pushes the cutting blade 13 in a direction toward the support member 38 (the leftward in FIG. 15A). Thus, the spring 49 is configured to push the cutting blade 13 back to an initial position after the paper P is cut.

The link members 36*a* and 36*b* are fixed to the movable member 11. First end portions of the link members 36*a* and 36*b* are inserted in the elongated hole portions 37*a* and 37*b* of the cutting blade 13, respectively, to support the cutting blade 13.

With this structure, as shown in FIG. 15A and FIG. 15B, when the movable member 11 moves in the direction shown by the arrow A, the cutting blade 13 is moved in the inclined direction (the direction shown by the arrow B) with respect to the surface of the paper P along the elongated hole portions 37*a* and 37*b* in which the link members 36*a* and 36*b* are respectively inserted and the inclined surface 39 of the support member 38 to cut the paper P.

As the cutting blade 13 moves in a direction (the Z-direction) perpendicular to the surface of the paper P as well as being moved in the width direction (the X-direction) of the paper P to be moved in the inclined direction with respect to the surface of the paper P, the paper P can be surely cut.

In the above embodiments, the thermal printer including the thermal head and the platen roller is exemplified as a recording apparatus. Alternatively, an electrophotographic or ink-jet type recording apparatus including the cutting device of the embodiments may be used.

According to the embodiments, a cutting device and a recording apparatus including the cutting device capable of surely cutting a recording medium is provided.

Although a preferred embodiment of the cutting device and the recording apparatus has been specifically illustrated and described, it is to be understood that minor modifications may be made therein without departing from the sprit and scope of the invention as defined by the claims.

The present invention is not limited to the specifically disclosed embodiments, and variations and modifications may be made without departing from the scope of the present invention. The present application is based on Japanese Priority Application No. 2012-005635 filed on Jan. 13, 2012, the entire contents of which are hereby incorporated by reference.

What is claimed is:

1. A cutting device comprising:

a cutting blade configured to cut a recording medium;

a support unit that supports the cutting blade to be movable in an inclined direction with respect to a surface of the recording medium such that the cutting blade is moved toward the recording medium while moving in a width direction of the recording medium;

a moveable unit that is movable in a direction perpendicular to a surface of the recording medium so as to cause the cutting blade supported by the support unit to be moved in the inclined direction to cut the recording medium.

2. The cutting device according to claim 1, further comprising:

a fixed blade provided to contact the cutting blade when the cutting blade is moved in the inclined direction to cut the recording medium in conjunction with the cutting blade.

3. The cutting device according to claim 1, wherein the support unit includes a carrier that detachably supports the cutting blade and is provided to be movable in the inclined direction.

4. The cutting device according to claim 1, wherein the support unit includes a support member provided with an open portion extending in the inclined direction in which the cutting blade is movably supported to be moved in the inclined direction along the open portion.

5. The cutting device according to claim 1, wherein the support unit includes a support member that includes a shaft portion extending in the inclined direction, and the cutting blade is movably supported by the shaft portion of the support member to be moved in the inclined direction along the shaft portion.

6. The cutting device according to claim 1, wherein the support unit includes a rotation shaft, a first guide member which is supported by the movable unit at one end and rotatably supported by the rotation shaft at the other end to be rotated around the rotation shaft in accordance with the movement of the movable unit, and a second guide member that includes a shaft portion extending in the inclined direction, and wherein the cutting blade is supported by the first guide member and the second guide member to be pushed by the first guide member when the first guide member is rotated in accordance with the movement of the movable unit and moved in the inclined direction along the shaft portion of the second guide member.

7. The cutting device according to claim 1, wherein the cutting blade includes a single edge or a double edge extending in a direction perpendicular to the surface of the recording medium.

8. The cutting device according to claim 1, wherein the cutting blade is a rotatable circular knife.

9. The cutting device according to claim 1, wherein the cutting blade includes a blade edge extending in a direction parallel to the surface of the recording medium, the support unit includes a support member provided with an inclined surface that extends in the inclined direction, and the cutting blade is moved by the moveable unit in the inclined direction along the inclined surface of the support member.

10. A recording apparatus comprising:

a recording unit that records an image on a recording medium; and the cutting device according to claim 1.

11. The cutting device according to claim 1, wherein the movable unit includes a rack gear unit so as to move the movable unit in the direction perpendicular to the recording medium.

* * * * *